United States Patent [19]

Knapp et al.

[11] Patent Number: 4,560,898

[45] Date of Patent: Dec. 24, 1985

[54] COLOR PICTURE DISPLAY TUBE

[75] Inventors: Alan G. Knapp, Crawley; John R. Mansell, East Grinstead, both of England

[73] Assignee: U.S. Philips Corporation, New York, N.Y.

[21] Appl. No.: 502,889

[22] Filed: Jun. 9, 1983

[30] Foreign Application Priority Data

Jun. 16, 1982 [GB] United Kingdom ..... 8217410

[51] Int. Cl.[4] ..... H01J 31/48

[52] U.S. Cl. ..... 313/400; 313/105 CM; 313/103 CM

[58] Field of Search ..... 313/400, 402, 403, 408, 313/411, 103 CM, 105 CM

[56] References Cited

U.S. PATENT DOCUMENTS

| | | | |
|---|---|---|---|
| 4,023,064 | 5/1977 | Schagen et al. | 313/400 |
| 4,227,115 | 10/1980 | Elshof et al. | 313/403 |
| 4,427,918 | 1/1984 | Lipp | 313/402 |
| 4,482,836 | 11/1984 | Washington et al. | 313/104 |

FOREIGN PATENT DOCUMENTS

| | | |
|---|---|---|
| 1434053 | 4/1976 | United Kingdom . |
| 2023332 | 12/1979 | United Kingdom . |

*Primary Examiner*—David K. Moore
*Attorney, Agent, or Firm*—Robert J. Kraus

[57] ABSTRACT

A deflection color selection system for a single beam channel plate display tube includes, within an envelope 10, a laminated dynode channel plate electron multiplier (16) having channels whose exit apertures are aligned in columns. An apertured extractor electrode (36) is mounted on and electrically insulated from an output face of the electron multiplier (16), the apertures (42) in the extractor electrode (36) being aligned with respective channels. A luminescent screen (14) spaced from the extractor electrode (36) includes patterns of phosphor elements (R, G, B) adapted to luminesce in different colors. A current multiplied electron beam 34 exiting from an aperture in the extractor electrode is deflected onto an associated pattern of phosphor elements by pairs of first (38) and second (40) deflector electrodes insulated electrically from each other and from the extractor electrodes, the first (38) and second (40) deflector electrodes being disposed as pairs between each column of apertures (42) in the extractor electrode (36). All of the first electrodes (38) are interconnected as are all of the second electrodes (40). This electrode arrangement enables good resolution and electrical correction of misalignment errors between the electron multiplier (16) and the screen (14).

8 Claims, 7 Drawing Figures

COLOR PICTURE DISPLAY TUBE

BACKGROUND OF THE INVENTION

The present invention relates to a colour picture display tube.

During the evolution of colour picture display tubes there have been many proposals for producing colour pictures using a single electron beam rather than three electron beams as is generally done in present day, commercially available colour picture display tubes. Generally these proposals have involved deflecting a high voltage beam onto a repeated pattern of phosphor strips or dots. Deflecting a high voltage beam requires high deflection voltages which would have to be switched at a high frequency and as a result this approach has not found commercial success.

British Patent Specification No. 1,458,909 dicloses a display tube which includes a channel plate electron multiplier which is scanned on an input side by a low energy electron beam. After current multiplication and focusing, the beam exiting from the multiplier is accelerated towards a phosphor screen. The channels in the electron multiplier are arranged in columns and between adjacent columns a single deflector electrode is mounted on the output face. Alternate electrodes are interconnected to form two sets of interdigitated selector strip electrodes. With this arrangement of electrodes, as the beam is scanned crosswise then at the exit side of the electron multiplier the electron beam leaving one aperture can be deflected left to right after which, the electron beam leaving an adjacent aperture in the same row can be subsequently deflected from right to left, and so on. In consequence the phosphor strips have to be arranged in a sequence P1, P2, P3, P2, P1, P2, P3 and so on. A disadvantage of such an arrangement is that it is not possible to correct electrically for small misalignments between the channel plate electron multiplier and the screen. Further, the colour resolution is impaired because the pitch of the P1 and P3 phosphors is twice that of the P2 phosphors.

SUMMARY OF THE INVENTION

It is an object of the present invention to overcome these disadvantages in a display tube having a channel plate electron multiplier.

According to the present invention there is provided a colour picture display tube comprising a laminated dynode channel plate electron multiplier, means for generating an electron beam to be scanned across an input face of the electron multiplier, an apertured extractor electrode mounted on, and electrically insulated from, an output face of the electron multiplier, apertures in the extractor electrode communicating with respective channels in the electron multiplier, a luminescent screen spaced from the extractor electrode, the screen comprising a repeating pattern of phosphor elements adapted to luminesce in different colours, each pattern comprising one of each type of phosphor only and, between apertures of the extractor electrode, pairs of first and second deflector electrodes electrically insulated from each other and the extractor electrode, the first electrode of each pair being coupled to the first electrodes of the other pairs and the second electrode of each pair being coupled to the second electrodes of the other pairs.

Compared to the colour display tube disclosed in British Patent Specification No. 1,458,909, the present invention enables a better resolution to be achieved because instead of different resolutions between the P2 phosphor and the P1 and P3 phosphors, the resolutions of all three phosphors can be made the same. Also the provision of pairs of deflection electrodes enables electrical corrections to be made for static misalignment errors.

In a preferred embodiment, the depth of each of the deflector electrodes is made equal to or greater than half the distance between the facing surfaces of the first electrode of one pair and the second electrode of an adjacent pair. By having relatively deep deflector electrodes in the direction normal to the screen it is possible to decrease the spot size on the screen and to reduce the deflection voltages.

In an embodiment of the present invention the apertures in the extractor electrode are arranged rectilinearly, for example in columns, and the first and second deflector electrodes are disposed between the lines of apertures. Such an arrangement simplifies the artwork involved in making the deflector electrodes by for example evaporation of electrically conductive material onto a suitably etched substrate.

The apertures in the extractor electrode may be elongate in the direction of the deflector electrodes. The elongate apertures augment the effect of the quadrupole lens formed by the deflector electrodes by producing a narrow elongate spot at the screen, which spot gives better colour purity whilst maintaining the picture brightness.

In one embodiment the thickness of the extractor electrode is greater than half the thickness of a dynode of the electron multiplier thus decreasing the magnification of the electron optical lens formed by the extractor and deflector electrodes, which effects production of a smaller spot.

BRIEF DESCRIPTION OF THE DRAWINGS

The present invention will now be described, by way of example, with reference to the accompanying drawing, wherein.

In the drawing corresponding reference numerals have been used to indicate the same parts in each of the embodiments.

DESCRIPTION OF THE PREFERRED EMBODIMENTS

Figure 1:
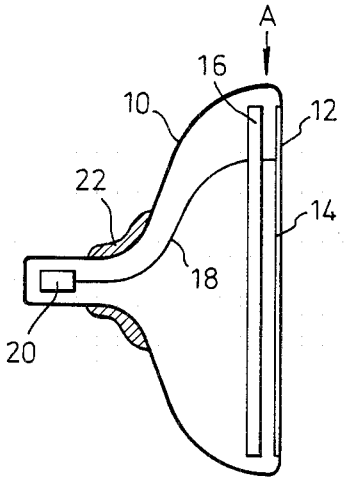
FIG. 1 is a diagrammatic elevation through a colour picture display tube made in accordance with the present invention.

The colour display tube shown in FIG. 1 comprises an envelope 10 with a substantially flat faceplate 12. On the faceplate 12, a phosphor screen 14 is provided comprising repeating groups of red, R, green, G, and blue, B, vertically extending phosphor lines. A laminated channel plate electron multiplier 16 is arranged parallel to, but spaced from, the screen 14. A device for producing a low energy electron beam 18, for example an electron gun 20 is disposed in a neck of the envelope 10. The electron beam 18 is scanned across the input face of the electron multiplier 16 by deflection means 22 mounted on the tube neck.

Figure 2:
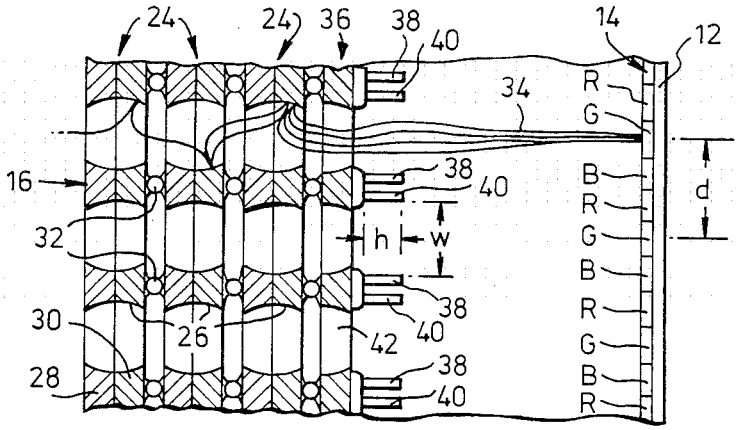
FIG. 2 is a sectional view, not to scale, of a portion of the final three stages of a laminated channel plate electron multiplier, the screen, and the faceplate, viewed in the direction A shown in FIG. 1.

The construction of the channel plate electron multiplier 16 is disclosed in British Pat. No. 1,434,053, corresponding to U.S. Pat. No. 4,482,836 which is hereby incorporated by reference, and in British Pat. No. 2,023,332A. Accordingly a detailed description of its construction and operation will not be given. However for the sake of completeness, the electron multiplier 16 comprises a plurality of apertured dynodes 24 of which the last three are shown in FIG. 2. The barrel-shaped apertures 26 in successive dynodes are aligned with each other to form channels. The dynodes 24 each comprise two half dynodes 28, 30 arranged back to back. Successive dynodes 24 are separated from each other by a resistive or insulating spacing means which in the illustrated embodiments comprise small glass balls 32 known as ballotini. In operation the electron beam 18 entering a channel undergoes current multiplication by secondary emission as it passes from one dynode to the next, each of which is typically 300 V more positive than the previous one. In order to extract the current multiplied electron beam 34 from the final dynode of the electron multiplier 16, an extractor electrode 36 is provided. This extractor electrode 36 generally comprises a half dynode mounted on, but spaced from, the final dynode. A positive voltage, typically +200 V relative to that of the last dynode, is applied to the extractor electrode 36 which not only draws out the electron beam 34 but also focuses it.

With the illustrated arrangement of the phosphors R, G and B in the repeating groups, an undeflected, current multiplied electron beam 34 will impinge on the green phosphor G. To impinge on the red, R, and blue, B, phosphors the electron beam 34 has to be deflected to the left and to the right, respectively. In the illustrated embodiment the deflection of the current multiplied electron beam 34 is achieved by pairs of electrodes 38, 40 arranged one on each side of an aperture 42 in the extractor electrode 36. As the apertures 42 are aligned rectilinearly in columns, see FIG. 3, then the electrodes 38, 40 are elongate. All the electrodes 38 are interconnected as are the electrodes 40. The electrodes 38, 40 are electrically insulated from the extractor electrode 36. These electrodes 38, 40 also have to be fairly deep to be effective, typically for an embodiment having circular apertures 42 the height h should be more than w/2, w being the distance between the electrodes 38, 40 associated with a particular aperture 42, and a typical value for h is 0.5 mm. The deflector electrodes 38, 40 act as part of the lens system which forms an electron beam 34 of the required size. The electrodes 38, 40 produce a quadrupole field which reduces the size of the spot on the screen in the x or lateral direction whilst increasing it in the y or vertical direction. Whilst increasing the depth h of the electrodes 38, 40 decreases the spot size and reduces the deflection voltage required, there is a corresponding increase in the capacitance between the two sets of deflector electrodes. An upper limit to the depth h is set by the onset of beam broadening due to spurious electrons produced at the extractor electrode 36 being able to reach the screen 14 since, for deeper deflection electrodes 38, 40, the mean deflector voltage for optimum beam focusing tends to be equal or somewhat more positive than the extractor electrode 36 voltage. Electrodes of this depth cannot be readily made by the various deposition or printing techniques and one method of making such deep electrodes will be described later with reference to FIGS. 6 and 7.

In operation, in order to deflect the electron beam 34 it is necessary to apply a potential difference between the sets of electrodes 38, 40. In a situation where relative to the final dynode the extractor electrode 36 is at +200 V and the screen 14 is at +7 to 10 kV, then for an undeflected beam 34 a mean voltage of +125 V is applied to the electrodes 38, 40 and to obtain a deflection in one direction or the other a potential difference of 60 V has to be produced so that for a deflection onto the red phosphor, R, the electrode 40 is at say +155 V whilst the electrode 38 is at +95 V, the voltages being the opposite way around for deflection onto the blue phosphor, B.

In producing a colour picture, the deflection of the beam 34 can be done in one of several ways. In a first way the electron beam 18 from the electron gun 20 scans the input face of the electron multiplier 16 at the normal television line scan rate. The current multiplied beam 34 leaves the extractor electrode 36 at the same line scan rate but in the time that it is being emitted from a channel, the electron beam 34 has to be deflected onto each of the three phosphors R, G and B of each group. This involves switching the voltage applied to the electrodes 38, 40 at higher than the picture element frequency whilst the intensity of the beam is switched from the luminance signal of one colour to another of the colours in synchronism. As the voltages applied to the electrodes 38, 40 are low then the switching of the voltages applied thereto can be achieved using semiconductor circuitry. A second way of producing a colour picture is to produce successively red, green and blue colour fields in the time of one overall field period, for example 20 mS for a standard 25 frames/second television picture. In order to do this the deflection means 22 causes the electron beam 18 to scan at three times the usual rate. The electron beam 18 is modulated in turn by say the red information, green information and blue information. Insofar as the voltages applied to the deflector electrodes 38, 40 are concerned, these are switched in synchronism with the colour field to be displayed at a particular instant.

Figure 4:
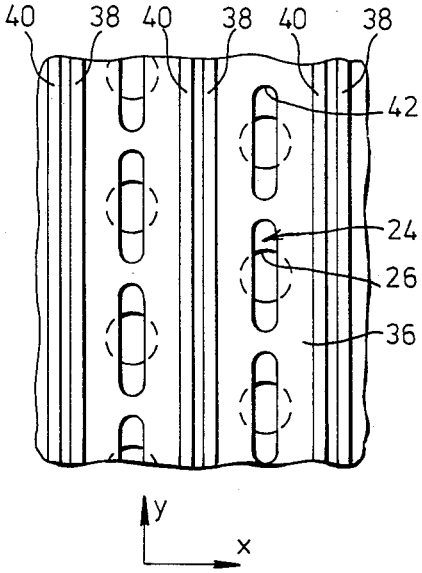
FIG. 4 is a diagrammatic elevational view, not to scale, of a portion of the exit face of another embodiment of the channel plate electron multiplier and deflector electrodes.

FIG. 4 illustrates an embodiment of the invention in which the apertures 42 in the extractor electrode 36 are elongate having a length greater than, and a width narrower than, the diameter of the exit aperture 26 of the final dynode 24. The elongate apertures have the effect of reducing the spot size in the x direction on the screen allowing improved colour purity to be obtained for a given phosphor pitch d (FIG. 2). This result is obtained by trimming the beam emerging from the final dynode in the x direction only so as to remove electrons which would contribute to the edges of the electron distribution on the screen. In this respect the elongate apertures 42 assist the quadrupole lens field produced by the deflector electrodes 38, 40.

Whilst an improved colour purity could be obtained by the apertures 42 being circular and of smaller diameter than that of the exit aperture of the final dynode, this has the disadvantages of producing undesired beam trimming in the y direction and of causing an undesirable reduction in the screen current and hence the picture brightness.

Figure 5:
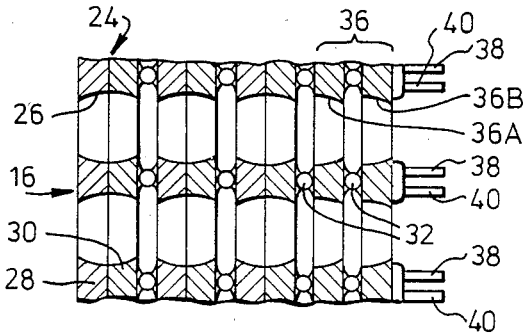
FIG. 5 is a cross-sectional view through the last three dynodes of a channel plate electron multiplier which has a deeper extractor electrode.

FIG. 5 illustrates an embodiment in which the extractor electrode 36 is made thicker by, for example, mounting at least two half dynodes 36A, 36B on the final dynode of the electron multiplier 16. As shown, each half dynode is separated from the other by spacing means, for example ballotini 32. If the spacing means is electrically insulating then the half dynodes 36A, 36B can be operated at different voltages. It should be noted that the half dynodes 36A, 36B could be contiguous with no spacing means therebetween. The increasing of the thickness of the extractor electrode 36 decreases the electron optical magnification of the system and produces a smaller spot on the screen. The apertures 42 in the extractor electrode 36 may be circular (as in FIG. 3) or elongate (as in FIG. 4).

By way of example, using an extractor and deflection system comprising an extractor electrode 36 formed of contiguous half dynodes 36A, 36B and having elongate apertures 42, $d=0.8$ mm, $w=0.35$ mm and $h=0.33$ mm, the minimum spot width occurs with an extractor electrode voltage of $+200$ V and a mean deflection voltage of $+125$ V with respect to the final dynode of the electron multiplier 16. In order to deflect the electron beam 34 a distance of 0.27 mm, that is d/3, a voltage of 60 V is required between the deflector electrodes 38, 40. The optimally focused beam has a full width, at half picture height, of 0.22 mm.

Figure 3:
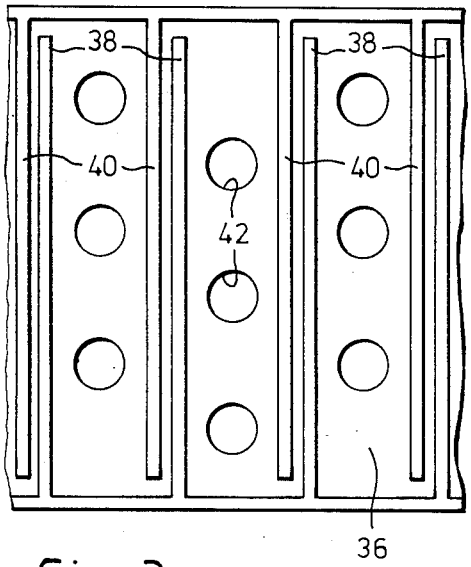
FIG. 3 is a diagrammatic elevational view, not to scale, of a portion of the exit face of one embodiment of the channel plate multiplier and deflector electrodes.

In all the embodiments described it is possible to apply a correction signal in such a way as to correct for small misalignments between the assembly formed by the electron multiplier 16, the extractor electrode 36 and the deflector electrodes 38, 40, and the screen 14. For example, for an assembly as shown in FIGS. 2 and 3 a constant misalignment in the x or lateral direction can be corrected by a DC voltage applied between the electrodes 38 and 40. A slight twisting of the screen 14 relative to the assembly can be corrected by applying a sawtooth correction signal at say field frequency between the electrodes 38, 40. Other types of misalignment, for example a small overall expansion and contraction of the screen pitch, d, compared with that of the electron multiplier 16, may be corrected by more complex waveforms applied between the deflector electrodes 38, 40.

Figure 6:
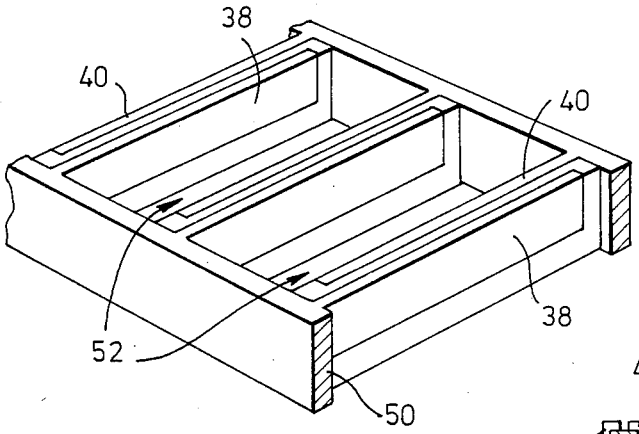
FIG. 6 is a perspective view, not to scale, of a deflector electrode assembly made of Fotoform glass, Registered Trade Mark, on which electrodes are provided.
Figure 7:
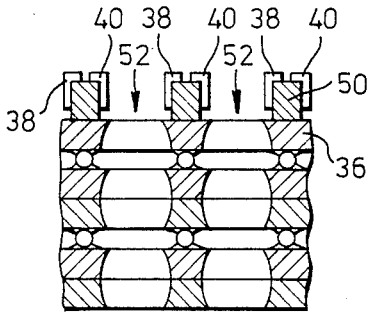
FIG. 7 is a diagrammatic cross-section through a portion of the last two dynodes of an electron multiplier showing the electrode assembly of FIG. 6 mounted on the extractor electrode.

FIGS. 6 and 7 illustrate a practical method of manufacturing the deflector electrodes 38, 40. A substrate 50 of an electrically insulating material, for example Fotoform, Registered Trade Mark, glass of the desired thickness, for example 0.5 to 0.8 mm, has elongate slots 52 etched through its thickness, the width of the slots corresponding substantially to w (FIG. 2), the distance between the facing surfaces of a set of electrodes 38, 40 arranged one on each side of an aperture 42 in the extractor electrode 36.

Thereafter an electrically conductive material is evaporated onto one end face of the etched substrate and down onto the sidewalls of the slots 52. Thereafter using photoresist techniques, known per se, the unwanted electrically conductive material is etched away to leave the electrodes 38 and 40. Care has to be exercised when etching the unwanted material to ensure that no material is left causing one or other of the electrodes 38, 40 to short to the nearby horizontal interconnecting strip for the other of the electrodes.

Mounting the integral deflector electrode assembly shown in FIG. 6 onto the extractor electrode 36 can be done directly as shown in FIG. 7. Alternatively if the electrodes 38, 40 extend to the full depth of the slots 52, then the integral assembly has to be mounted using an electrically insulating material. If bonding is contemplated care has to be taken to ensure that the coefficients of expansions of the various materials match each other.

Although the channels of the electron multiplier 16 and the respective apertures of the extractor electrode have been described and illustrated as being arranged rectilinearly in columns, other rectilinear and non-rectilinear arrangements may be adopted.

Further, the electron beam deflector arrangement described and illustrated may be applied to any type of display tube including a channel plate electron multiplier, because the input conditions to the electron multiplier are separated from the output ones.

We claim:

1. A color display tube comprising:

(a) a laminated dynode channel plate electron multiplier;

(b) means for producing an electron beam and scanning said beam across an input face of the electron multiplier;

(c) an apertured extractor electrode mounted on but electrically insulated from an output face of the electron multiplier, apertures in the extractor electrode communicating with respective channels in the electron multiplier;

(d) a luminescent screen spaced from an output face of the extractor electrode and comprising a repetitive pattern of groups of phosphor elements, the phosphor elements in each group adapted to luminesce in different colors; and (e) pairs of first and second deflector electrodes mounted on the output face of the extractor electrode, each pair being disposed between adjacent apertures in the extractor electrode, the first and second deflector electrodes in each pair being electrically insulated from each other and from the extractor electrode, all of the first deflector electrodes being electrically connected to each other and all of the second deflector electrodes being electrically connected to each other, ones of the first and second deflector electrodes disposed on opposite sides of each aperture in the extractor electrode effecting deflection of electrons emerging from the aperture to a selected one of the phosphor elements in a group corresponding to said aperture when a respective predetermined potential difference is applied to said first and second deflector electrodes.

2. A display tube as in claim 1 where the height of each deflector electrode is at least equal to half of the distance between facing surfaces of ones of the first and second electrodes disposed on opposite sides of a respective aperture in the extractor electrode.

3. A display tube as in claim 1 or 2 where the deflector electrodes are exposed on an electrically insulating substrate having openings therein corresponding to apertures in the extractor electrode.

4. A display tube as in claim 1 or 2 where the apertures in the extractor electrode are arranged in columns, and where each pair of deflector electrodes comprises a first and second linear electrode extending along the length of the extractor electrode between adjacent columns of the apertures.

5. A display tube as in claim 1 or 2 where the apertures in the extractor electrodes are elongate in the direction of extension of the deflector electrodes.

6. A display tube as in claim 1 or 2 where the height of the extractor electrode is larger than half the thickness of one of the laminated dynodes of the channel plate electron multiplier.

7. A display tube as in claim 6 where the extractor electrode comprises a plurality of contiguously arranged apertured electrodes.

8. A display tube as in claim 6 where the extractor electrode comprises at least two electrodes insulated from each other for operation at different electrical potentials.

* * * * *